US007746307B2

(12) United States Patent
Hsieh et al.

(10) Patent No.: US 7,746,307 B2
(45) Date of Patent: Jun. 29, 2010

(54) LIQUID CRYSTAL DISPLAY AND DRIVING METHOD THEREOF

(75) Inventors: Ming-Feng Hsieh, Tainan County (TW); Chih-Yung Hsieh, Tainan County (TW)

(73) Assignee: Chi Mei Optoelectronics Corp., Tainan County (TW)

( * ) Notice: Subject to any disclaimer, the term of this patent is extended or adjusted under 35 U.S.C. 154(b) by 547 days.

(21) Appl. No.: 11/782,430

(22) Filed: Jul. 24, 2007

(65) Prior Publication Data

US 2008/0024411 A1 Jan. 31, 2008

(30) Foreign Application Priority Data

Jul. 26, 2006 (TW) ..... 95127323 A

(51) Int. Cl.
*G09G 3/36* (2006.01)

(52) U.S. Cl. ..... 345/89; 345/613; 345/690

(58) Field of Classification Search ..... 345/87, 345/89, 92, 100, 103, 204, 613, 690; 349/85, 349/144, 145, 146; 382/169
See application file for complete search history.

(56) References Cited

U.S. PATENT DOCUMENTS 6,894,670 B2 * 5/2005 Funakoshi et al. ..... 345/89
7,268,758 B2 * 9/2007 Schlegel ..... 345/88
7,629,955 B2 * 12/2009 Asao et al. ..... 345/96

* cited by examiner

*Primary Examiner*—Abbas I Abdulselam

(57) ABSTRACT

A LCD includes at least a first sub-pixel and a second sub-pixel with different area. Each sub-pixel displays luminance according to a positive or a negative data voltage corresponding to a grey value. When the grey values of the first sub-pixel and the second sub-pixel are equal, an average value of the positive and negative data voltages of the first sub-pixel is not equal to an average value of the positive and negative data voltages of the second sub-pixel.

8 Claims, 7 Drawing Sheets

| Grey value | | 0 | 64 | 128 |
|---|---|---|---|---|
| First sub-pixel | Positive data voltage | $V_a$ | $V_b$ | $V_c$ |
| | Negative data voltage | $2(V_{com}+\Delta V_{0})-Va$ | $2(V_{com}+\Delta V_{64})-Vb$ | $2(V_{com}+\Delta V_{128})-Vc$ |
| Second sub-pixel | Positive data voltage | $V_a'$ | $V_b'$ | $V_c'$ |
| | Negative data voltage | $2(V_{com}+\Delta V_{0'})-V_{a'}$ | $2(V_{com}+\Delta V_{64'})-V_{b'}$ | $2(V_{com}+\Delta V_{128'})-V_{c'}$ |

| Grey value | | 192 | 255 |
|---|---|---|---|
| First sub-pixel | Positive data voltage | $V_d$ | $V_e$ |
| | Negative data voltage | $2(V_{com}+\Delta V_{192})-V_{d}$ | $2(V_{com}+\Delta V_{255})-V_{e}$ |
| Second sub-pixel | Positive data voltage | $V_d'$ | $V_e'$ |
| | Negative data voltage | $2(V_{com}+\Delta V_{192'})-V_{d'}$ | $2(V_{com}+\Delta V_{255'})-V_{e'}$ |

FIG. 4

LIQUID CRYSTAL DISPLAY AND DRIVING METHOD THEREOF

This application claims the benefit of Taiwan application Serial No. 95127323, filed Jul. 26, 2006, the subject matter of which is incorporated herein by reference.

BACKGROUND OF THE INVENTION

1. Field of the Invention

The invention relates in general to a liquid crystal display (LCD) and driving method thereof, and more particularly to a LCD applying a feed-through voltage and driving method thereof.

2. Description of the Related Art

In a conventional LCD, if the sub-pixels of a display unit have the same area, when receiving the same data voltage, each sub-pixel has substantially the same capacitance of the liquid crystal capacitor, gate-drain parasitic capacitor and storage capacitor, and thus the same feed-through voltage. Owing to the fact that the capacitance of the liquid crystal capacitor of a sub-pixel is related to the data voltage received and the area and shape of the sub-pixel, when two sub-pixels are different in area or shape, the two sub-pixels will have different feed-through voltages.

Referring to FIG. 1, an equivalent circuit diagram of a part of the sub-pixels in a conventional LCD is shown. In a driving circuit of sub-pixels, it is supposed that a sub-pixel A and a sub-pixel B are different in either area or shape. Therefore, when the sub-pixels A and B receive the same data voltage, the liquid crystal capacitor $C_{lc1}$ of the sub-pixel A is different from the liquid crystal capacitor $C_{lc2}$ of the sub-pixel B. Because the sub-pixels A and B have the same transistor design, the gate-drain parasitic capacitor $C_{gd1}$ of the sub-pixel A is the same as the gate-drain parasitic capacitor $C_{gd2}$ of the sub-pixel B and the storage capacitor $C_{s1}$ of the sub-pixel A is also the same as the storage capacitor $C_{s2}$ of the sub-pixel B.

The feed-through voltage will be disclosed in detail according to the equivalent circuit of the sub-pixel A in FIG. 1. Referring to FIG. 1, at the time when the voltage at the gate line changes, for the sake of capacitor coupling of the transistor switch T1, the voltage of the pixel electrode of the sub-pixel A is shifted down due to a feed-through effect and the shift amount of the pixel-electrode voltage is called a feed-through voltage. When the gate line is enabled, the gate voltage of the sub-pixel A is increased from $V_{gl}$ to $V_{gh}$, the feed-through voltage is $(V_{gh}-V_{gl})\times C_{gd1}/(C_{s1}+C_{gd1}+C_{lc1})$. It can be seen that the feed-through voltage is related to the liquid crystal capacitor, gate-drain parasitic capacitor and storage capacitor. Therefore, when the sub-pixel A is different from the sub-pixel B in area, the liquid crystal capacitor, gate-drain parasitic capacitor and storage capacitor of the sub-pixel A are also respectively different from those of the sub-pixel B. As a result, the feed-through voltages generated by the sub-pixels A and B are also different. Therefore, when a positive data voltage or a negative data voltage corresponding to the same grey value, is input, the sub-pixels A and B will generate different luminance.

Referring to FIG. 2, an example of a waveform diagram of the driven sub-pixels A and B is shown. The vertical axis (ordinate) of the waveform diagram represents a voltage value and the transverse axis (abscissa) of the waveform diagram represents time. The waveform 201 is a partial waveform of a scan-line signal and the waveform 202 is a partial waveform of a voltage inputted to the sub-pixels A and B via a data line. The waveforms 203 and 204 are respectively voltage waveforms of the pixel electrodes of the sub-pixels A and B. From the waveform 203, it can be seen that in the first frame period F1, after the sub-pixel A receives a positive data voltage V+, due to the feed-through effect generated as the scan voltage is decreased from a high level to a low level, the voltage of the pixel electrode of the sub-pixel A will be shifted down by a first feed-through voltage $\Delta V_{f1}$ to become a voltage $V_{a+}$. In the first frame period F1, after the sub-pixel B receives the same positive data voltage V+, due to the feed-through effect, the voltage of the pixel electrode of the sub-pixel B will be shifted down by a second feed-through voltage $\Delta V_{f2}$ to become $V_{b+}$.

Similarly, in the second frame period F2, after the sub-pixel A receives a negative data voltage V−, due to the feed-through effect generated as the scan voltage is decreased from a high level to a low level, the voltage of the pixel electrode of the sub-pixel A will be shifted down by a first feed-through voltage $\Delta V_{f1}$ to become a voltage $V_{a-}$. In the second frame period F2, after the sub-pixel B receives the same negative data voltage V−, due to the feed-through effect, the voltage of the pixel electrode of the sub-pixel B will be shifted down by a second feed-through voltage $\Delta V_{f2}$ to become $V_{b-}$.

Owing to the fact that the sub-pixels A and B are different in area, the first feed-through voltage $\Delta V_{f1}$ is not equal to the second feed-through voltage $\Delta V_{f2}$. It is assumed that $\Delta V_{a1}$ is an absolute difference between the voltage $V_{a+}$ and the common voltage $V_{com}$, $\Delta V_{b1}$ is an absolute difference between the voltage $V_{a-}$ and the common voltage $V_{com}$, $\Delta V_{a2}$ is an absolute difference between the voltage $V_{b+}$ and the common voltage $V_{com}$ and $\Delta V_{b2}$ is an absolute difference between the voltage $V_{b-}$ and the common voltage $V_{com}$. When adjusting the positive data voltage and negative data voltage for driving the sub-pixels according to the first feed-through voltage $\Delta V_{f1}$ of the sub-pixel A, such that the positive pixel voltage and negative pixel voltage of the pixel electrode of the sub-pixel A are symmetrical to the common voltage $V_{com}$ under the feed-through effect, after the sub-pixel B receives the adjusted positive data voltage and negative data voltage, the voltage of the pixel electrode of the sub-pixel B is always not symmetrical to the common voltage $V_{com}$ under the feed-through effect. Therefore, when in polarity inversion, the sub-pixel B receives the positive data voltage and negative data voltage corresponding to the same grey value, due to the feed-through effect, the positive pixel voltage and negative pixel voltage of the pixel electrode of the sub-pixel B are not symmetrical with respect to the common voltage $V_{com}$, and consequently, the sub-pixel B correspondingly displays different luminance, which results in frame flash.

SUMMARY OF THE INVENTION

The invention is directed to a LCD in order to resolve the issue of frame flash generated by polarity inversion of the sub-pixels with different area or shape.

According to a first aspect of the present invention, a LCD is provided. The LCD comprises a data driver, data lines, scan lines, scan driver and display units. The data lines are electrically coupled to the data driver. The scan driver is configured to sequentially enable the scan lines. Each of the display units comprises at least a first sub-pixel and a second sub-pixel. The first sub-pixel is controlled by one of the scan lines and used for receiving a first positive data voltage or a first negative data voltage from one of the data lines to generate luminance corresponding to a first grey value or a second grey value. The second sub-pixel is controlled by one of the scan lines, wherein the first sub-pixel and the second sub-pixel are not the same in area or shape, the second sub-pixel is used for receiving a second positive data voltage or a second negative data voltage from one of the data lines to generate luminance corresponding to a third grey value or a fourth grey value. When the first to the fourth grey values are equal, an average value of the first positive data voltage and the first negative data voltage is not equal to an average value of the second positive data voltage and the second negative data voltage.

According to a second aspect of the present invention, a driving method is provided. The driving method is applied to a LCD having a plurality of display units and data lines, each display unit comprises at least a first sub-pixel and a second sub-pixel, the first sub-pixel and the second sub-pixel are not the same in area, the first sub-pixel used for receiving a first positive data voltage or a first negative data voltage from one of the data lines to generate luminance corresponding to a first grey value or a second grey value; the second sub-pixel is used for receiving a second positive data voltage or a second negative data voltage from one of the data lines to generate luminance corresponding to a third grey value or a fourth grey value. The driving method comprises generating the first positive data voltage according to a first feed-through voltage of the first sub-pixel corresponding to the first grey value and inputting the first positive data voltage to the first sub-pixel; generating the first negative data voltage according to a second feed-through voltage of the first sub-pixel corresponding to the second grey value and inputting the first negative data voltage to the first sub-pixel; generating the second positive data voltage according to a third feed-through voltage of the second sub-pixel corresponding to the third grey value and inputting the second positive data voltage to the second sub-pixel; and generating the second negative data voltage according to a fourth feed-through voltage of the second sub-pixel corresponding to the fourth grey value and inputting the second negative data voltage to the second sub-pixel; when the first to the fourth grey values are substantially equal, an average value of the first positive data voltage and the first negative data voltage is not equal to an average value of the second positive data voltage and the second negative data voltage.

The invention will become better understood from the following detailed description of the preferred but non-limiting embodiments. The following description is made with reference to the accompanying drawings.

BRIEF DESCRIPTION OF THE DRAWINGS

FIG. 4 is a table of the positive data voltages and negative data voltages of the first sub-pixel and the second sub-pixel of the display unit of the LCD corresponding to various grey values.

DETAILED DESCRIPTION OF THE INVENTION

The invention is directed to a LCD and driving method thereof. Each display unit of the LCD has a number of sub-pixels with different area or shape. When the sub-pixels with different area or shape are to be driven by the same grey value, for different sub-pixels, different positive data voltages and negative data voltages are needed to be set according to the feed-through voltages of the sub-pixels. Therefore, the issue of frame flash can be effectively resolved.

Figure 1:
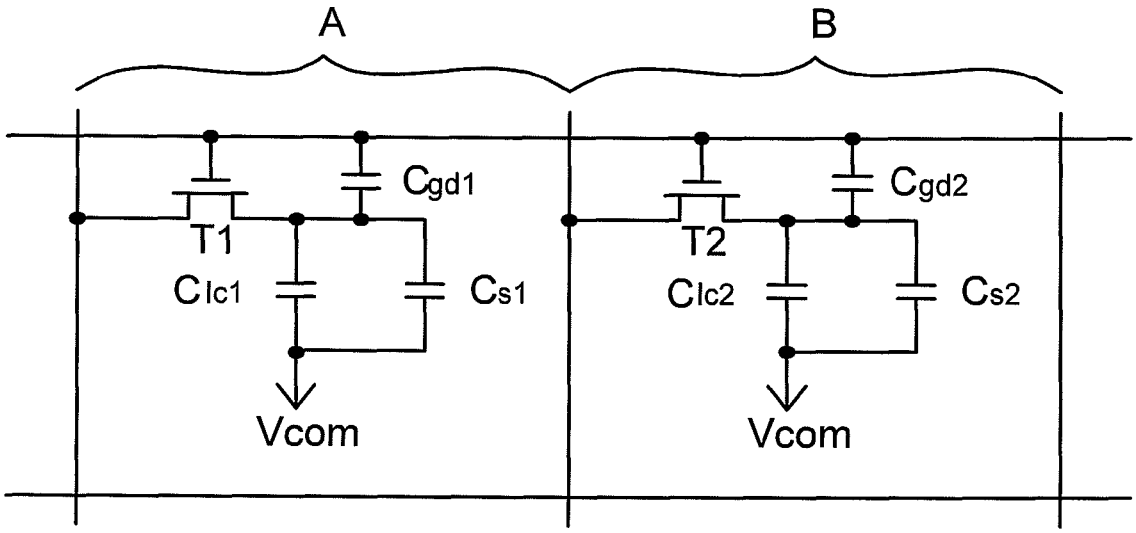
FIG. 1 is an equivalent circuit diagram of a part of the sub-pixels in a conventional LCD.
Figure 2:
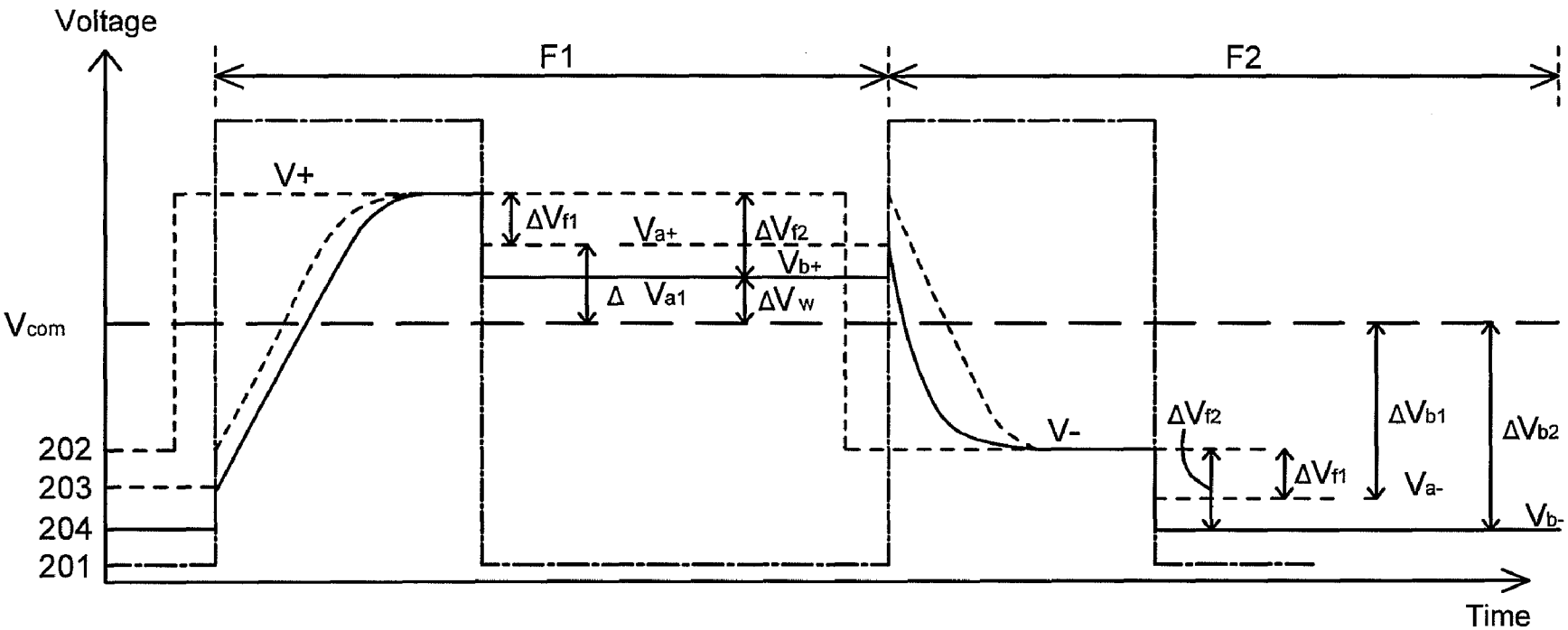
FIG. 2 is an example of a waveform diagram of the driven sub-pixels A and B.
Figure 3:
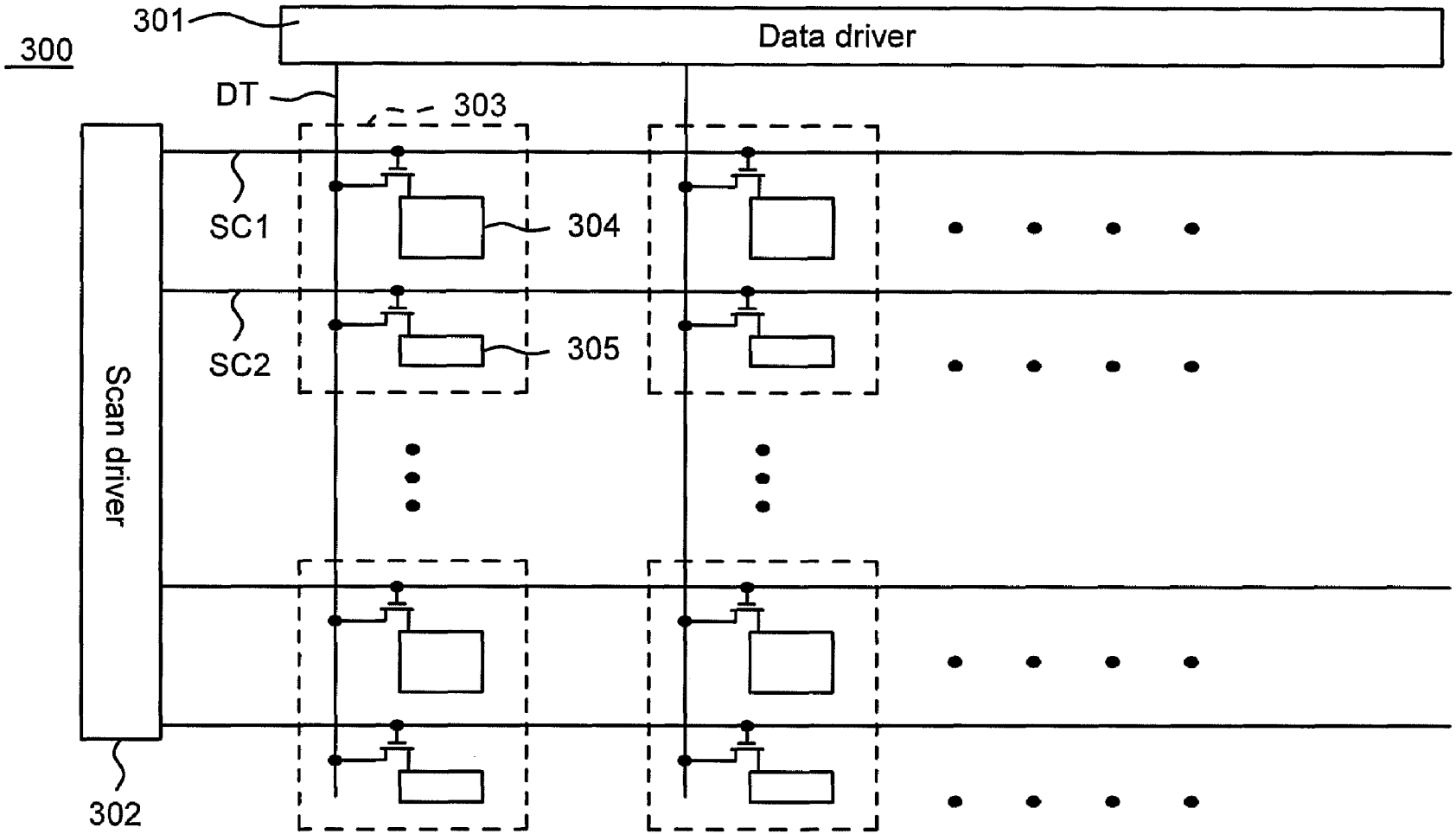
FIG. 3 is a schematic partial diagram of a LCD according to an embodiment of the invention.

Referring to FIG. 3, a schematic partial diagram of a LCD according to the embodiment of the invention is shown. A LCD 300 includes a number of display units 303, a data line DT, scan lines SC1 and SC2, a scan driver 302 and a data driver 301. The display unit 303 includes a first sub-pixel 304 and a second sub-pixel 305, wherein the first sub-pixel 304 is larger than the second sub-pixel 305 in terms of area.

Referring to FIG. 4, a table of the positive data voltages and negative data voltages of the first sub-pixel 304 and the second sub-pixel 305 of the display unit 303 of the LCD 300 corresponding to various grey values, is shown. As shown in FIG. 4, the positive data voltages of the first sub-pixel 304 corresponding to the grey values 0, 64, 128, 192 and 255 are respectively Va, Vb, Vc, Vd and Ve. The negative data voltages of the first sub-pixel 304 corresponding to the above grey values are respectively $2(V_{com}+\Delta V_0)-V_a$, $2(V_{com}+\Delta V_{64})-V_b$, $2(V_{com}+\Delta V_{128})-V_c$, $2(V_{com}+\Delta V_{192})-V_d$, and $2(V_{com}+\Delta V_{255})-V_e$. The positive data voltages of the second sub-pixel 305 corresponding to the grey values 0, 64, 128, 192 and 255 are respectively Va', Vb', Vc', Vd' and Ve'. The negative data voltages of the second sub-pixel 305 corresponding to the above grey values are respectively $2(V_{com}+\Delta V_0')-V_a'$, $2(V_{com}+\Delta V_{64}')-V_b$, $2(V_{com}+\Delta V_{128}')-V_c'$, $2(V_{com}+\Delta V_{192}')-V_d'$, and $2(V_{com}+\Delta V_{255}')-V_e'$.

$V_{com}$ is a common voltage of the first sub-pixel 304 and the second sub-pixel 305. $\Delta V_0$, $\Delta V_{64}$, $\Delta V_{128}$, $\Delta V_{192}$, and $\Delta V_{255}$ are respectively the feed-through voltages of the first sub-pixel 304 as displaying the grey values 0, 64, 128, 192 and 255. $\Delta V_0'\Delta V_{64}'$, $\Delta V_{128}'$, $\Delta V_{192}'$, and $\Delta V_{255}'$ are the feed-through voltages of the second sub-pixel 305 as displaying the grey values 0, 64, 128, 192 and 255, respectively.

Owing to the fact that the liquid crystal capacitor of a sub-pixel changes as the applied voltage is increased, the sub-pixels with the same area or shape may have different feed-through voltages corresponding to different grey luminance and thus the positive or negative data voltages of the sub-pixels with the same area or shape are set to be different in this embodiment. Therefore, the positive or negative data voltage corresponding to each grey value is different. Take the first sub-pixel 304 as an example, the average values of the positive and the negative data voltages of the first sub-pixel 304 corresponding to different grey values are $(V_{com}+\Delta V_0)$, $(V_{com}+\Delta V_{64})$, $(V_{com}+\Delta V_{128})$, $(V_{com}+\Delta V_{192})$ and $(V_{com}+\Delta V_{255})$. That is, the average values of the positive and the negative data voltages of the first sub-pixel 304 corresponding to different grey values are not equal.

Figure 5:
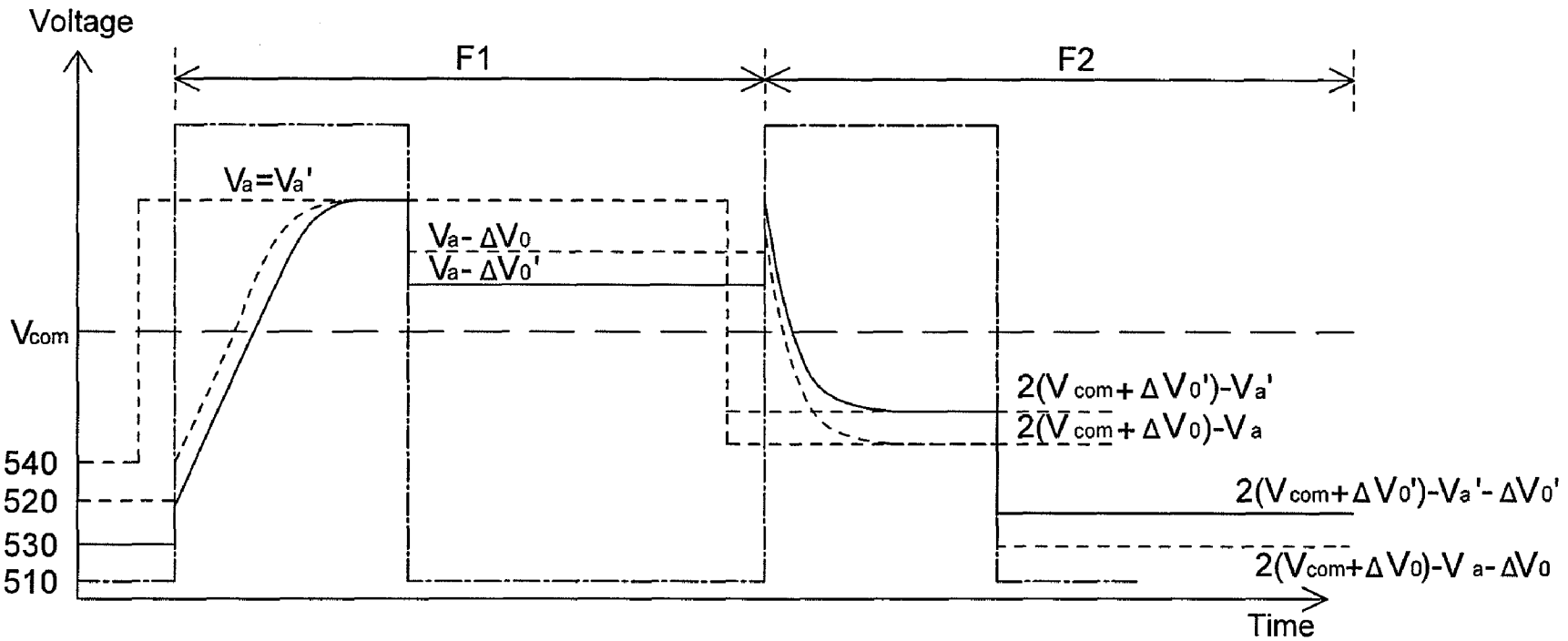
FIG. 5 is an example of a waveform diagram of the first sub-pixel and the second sub-pixel of FIG. 4 as receiving the positive and the negative data voltages corresponding to the grey value 0.

The following description illustrates the compensation effect of the sub-pixel of the display unit of the LCD in the embodiment on feed-through voltage as receiving the positive data voltage or the negative data voltage. It is illustrated the first sub-pixel 304 receives a positive data voltage and a negative data voltage corresponding to the grey value 0 in polarity inversion of the first sub-pixel 304 of FIG. 4. Referring to FIG. 5, an example of a waveform diagram of the first sub-pixel 304 and the second sub-pixel 305 of FIG. 4 as receiving the positive and the negative data voltages corresponding to the grey value 0 is shown. The waveform 510 is a partial waveform of a scan-line signal, the waveform 540 is a partial waveform of the voltage inputted to the first sub-pixel 304 and the second sub-pixel 305 via a data line. The waveform 520 is an example of a waveform of the first sub-pixel 304 as receiving a positive data voltage $V_a$ and a negative data voltage $2(V_{com}+\Delta V_0)-V_a$ corresponding to the grey value 0. In the first frame period F1, due to the feed-through effect, when the first sub-pixel 304 receives the positive data voltage $V_a$ and the corresponding gate-line signal changes from a high level to a low level, the pixel-electrode voltage of the first sub-pixel 304 is changed to $(V_a-\Delta V_0)$. In the second frame period F2, when the first sub-pixel 304 receives the negative data voltage $2(V_{com}+\Delta V_0)-V_a$ and the corresponding gate-line signal changes from a high level to a low level, the pixel-electrode voltage of the first sub-pixel 304 is changed to $2(V_{com}+\Delta V_0)-V_a-\Delta V_0$. In the first sub-pixel 304, the average of the pixel-electrode voltages corresponding to the positive and negative data voltages of the grey value 0 is $V_{com}$. That is, when the first sub-pixel 304 performs polarity inversion to input the positive and the negative data voltages compensated with the feed-through voltage $\Delta V_0$ corresponding to the grey value 0, the pixel voltages of the pixel electrode of the first sub-pixel 304 corresponding to the positive and the negative data voltages are symmetrical with respect to the common voltage $V_{com}$ to generate the same display luminance under the feed-through effect. Therefore, in different frame periods, when the first sub-pixel is driven by the data voltages with different polarities corresponding to the same grey value, the frame flash problem will not occur.

The waveform 530 is an example of a waveform of the second sub-pixel 305 as receiving a positive data voltage $V_a'$ and a negative data voltage $2(V_{com}+\Delta V_0')-V_a'$ corresponding to the grey value 0. In the second frame period F2, when the second sub-pixel 305 receives the positive data voltage $V_a'$ and negative data voltage $2(V_{com}+\Delta V_0')-V_a'$, the pixel voltages of the pixel electrode of the second sub-pixel 305 are symmetrical to the common voltage $V_{com}$ under the feed-through effect, which is the same as the first sub-pixel 304 mentioned above and any detail is necessary to be given here.

In the following description, the other features of the positive and negative data voltages of the sub-pixels of the LCD in the embodiment will be illustrated in details. From the table of FIG. 4, owing that the feed-through voltages of the first sub-pixel 304 and the second sub-pixel 305 corresponding to the same grey value are different, the positive and negative data voltages of the first sub-pixel 304 and the second sub-pixel 305 corresponding to the same grey value are set to be different. Take the grey value 0 as an example, the average of the positive and negative data voltages of the first sub-pixel 304 corresponding to the grey value 0 is $(V_{com}+\Delta V_0)$, which is not equal to the average $(V_{com}+\Delta V_0')$ of the positive and negative data voltages of the second sub-pixel 305 corresponding to the grey value 0. Similarly, the average values of the positive and negative data voltages of the first sub-pixel 304 corresponding to the grey values 64, 128, 192, 255 are not equal to those of the positive and negative data voltages of the second sub-pixel 305 corresponding to the grey values 64, 128, 192, 255.

From the table of FIG. 4, take the grey value 0 as an example, if the positive data voltage $V_a'$ of the second sub-pixel 305 corresponding to the grey value 0 is equal to the positive data voltage $V_a$ of the first sub-pixel 304 corresponding to the grey value 0, the negative data voltage of the second sub-pixel 305 is not the same as the negative data voltage $2(V_{com}+\Delta V_0)-V_a$ of the first sub-pixel 304, but the value $2(V_{com}+\Delta V_0')-V_a$. Similarly, if the positive data voltage of the first sub-pixel 304 corresponding to a certain grey value is equal to that of the second sub-pixel 305 corresponding to that grey value, the negative data voltage of the first sub-pixel 304 corresponding to that grey value is not equal to that of the second sub-pixel 305 corresponding to that grey value.

Furthermore, from the table of FIG. 4, take the grey value o as an example, if the positive data voltage $V_a'$ of the second sub-pixel 305 corresponding to the grey value 0 is equal to the positive data voltage $V_b$ of the first sub-pixel 304 corresponding to the grey value 64, the negative data voltage of the second sub-pixel 305 is not the same as the negative data voltage $2(V_{com}+\Delta V_{64})-V_b$ of the first sub-pixel 304, but the value $2(V_{com}+\Delta V_0')-V_b$. Similarly, if the positive data voltage of the first sub-pixel 304 corresponding to a certain grey value x is equal to the positive data voltage of the second sub-pixel 305 corresponding to another grey value y, the negative data voltage of the first sub-pixel 304 corresponding to the grey value x is not equal to that of the second sub-pixel 305 corresponding to the grey value y.

The display unit of the LCD in the embodiment of the invention includes a first sub-pixel and a second sub-pixel with different area or shape. The first sub-pixel and the second sub-pixel respectively receive the positive data voltage and the negative data voltage set corresponding to the feed-through voltage of each grey value such that in the polarity inversion of the first sub-pixel, the first sub-pixel will display the same luminance as receiving the positive and the negative data voltages corresponding to the same grey value. Similarly, the other sub-pixels of the LCD can also achieve the same effect as the first sub-pixel.

The display unit 303 of the LCD 300 of the embodiment includes a first sub-pixel 304 and a second sub-pixel 305. In actual application, the display unit of the LCD is not limited to having two pixels with different areas. The sub-pixels in the display unit of the LCD can also have other configuration as required. Therefore, the LCD of the invention can also have other sub-pixels with different shape or area.

Figure 6B:
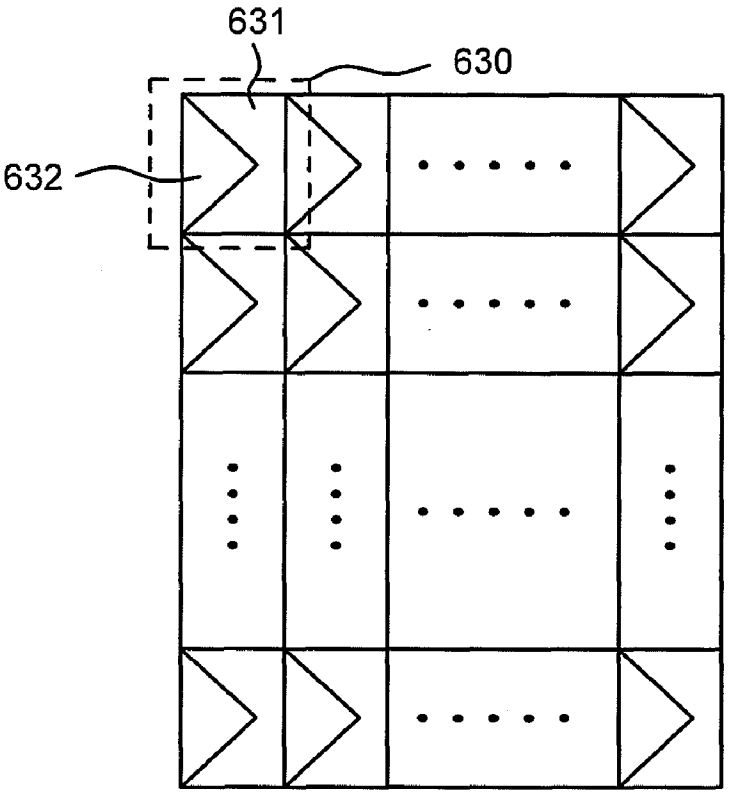
FIGS. 6A-6C show other configuration diagrams of the sub-pixels of the display unit of the LCD in the invention.
Figure 6A:
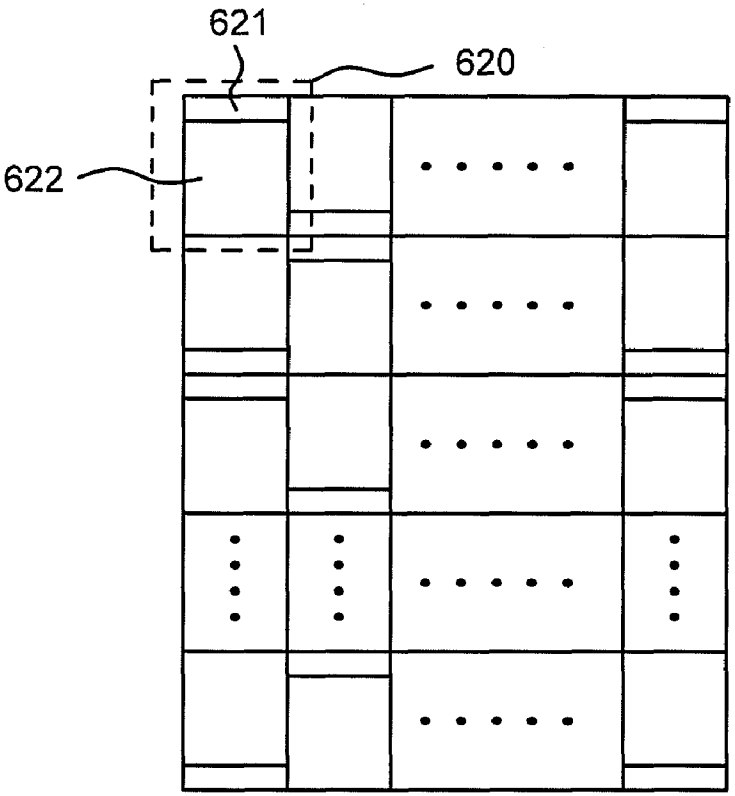
Figure 6C:
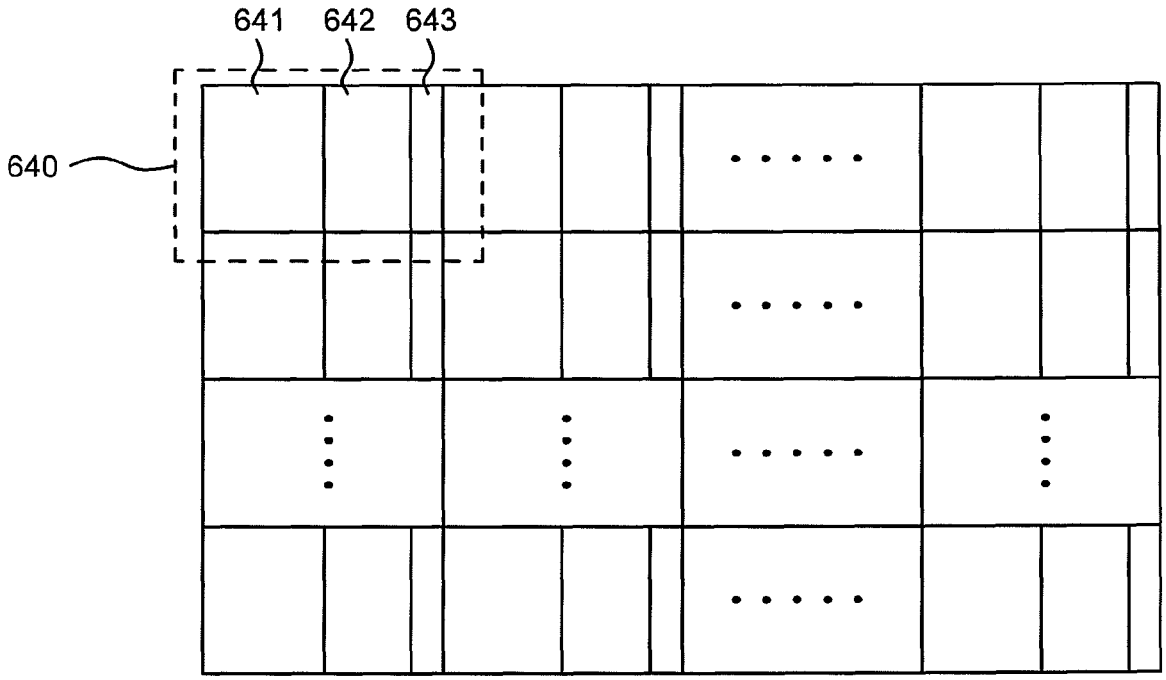

FIGS. 6A-6C show other configuration diagrams of the sub-pixels of the display unit of the LCD according to the invention. Referring to FIG. 6A, each display unit of the LCD includes two sub-pixels with different area. Take a display unit 620 as an example, the display unit 620 includes two sub-pixels 621 and 622, wherein the sub-pixel 621 is larger in area than the sub-pixel 622. The adjacent sub-pixels of the display unit are arranged a staggered configuration. FIG. 6B shows another configuration of the sub-pixels of the display unit of the LCD in the invention. Each display unit of the LCD includes two sub-pixels with different shapes. Take a display unit 630 as an example, the display unit 630 includes two pixels 631 and 632 with different shapes. FIG. 6C shows another configuration of the sub-pixels of the display unit of the LCD in the invention. Each display unit of the LCD includes a red sub-pixel, a green sub-pixel and a blue sub-pixel. The area of the red sub-pixel is larger than that of the green sub-pixel and the area of the green sub-pixel is larger than the blue sub-pixel. Take a display unit 640 as an example, the display unit 640 includes a red pixel 641, a green sub-pixel 642 and a blue sub-pixel 643, wherein the area of the red sub-pixel 641 is larger than that of the green sub-pixel 642 and the area of the green sub-pixel 642 is larger than the blue sub-pixel 643. The invention can also be applied to a LCD dividing a display unit into two sub-pixels for compensating color variation in image display.

No matter what kind of LCD it is, if the sub-pixels of the display unit have different area or shape, and the positive and negative data voltages received by the sub-pixels are set according to the feed-through voltage of each grey value, all these will not depart from the scope of the invention. The invention can effectively resolve the frame flash issue which occurs as the sub-pixels with different area or shape of a display unit display luminance corresponding to the same grey value in polarity inversion. Therefore, the invention can effectively improve the image quality.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A liquid crystal display (LCD), comprising:

a data driver;

a plurality of data lines, electrically coupled to the data driver;

a plurality of scan lines;

a scan driver, for sequentially enabling the scan lines; and a plurality of display units, each comprising at least:

a first sub-pixel, controlled by one of the scan lines and used for receiving a first positive data voltage or a first negative data voltage from one of the data lines to generate luminance corresponding to a first grey value or a second grey value; and a second sub-pixel, controlled by one of the scan lines, wherein the first sub-pixel and the second sub-pixel are not the same in area or shape, the second sub-pixel is used for receiving a second positive data voltage or a second negative data voltage from one of the data lines to generate luminance corresponding to a third grey value or a fourth grey value;

wherein when the first to the fourth grey values are equal, an average value of the first positive data voltage and the first negative data voltage is not equal to an average value of the second positive data voltage and the second negative data voltage.

2. The LCD according to claim 1, wherein the first sub-pixel further receives a third positive data voltage or a third negative data voltage from one of the data lines to generate luminance corresponding to a fifth grey value or a sixth grey value;

wherein when the first grey value is equal to the second grey value, the fifth grey value is equal to the sixth grey value and when the first grey value is not equal to the fifth grey value, the average value of the first positive data voltage and the first negative data voltage is not equal to an average voltage of the third positive data voltage and the third negative data voltage.

3. A LCD, comprising:

a data driver;

a plurality of data lines, electrically coupled to the data driver;

a plurality of scan lines;

a scan driver, for sequentially enabling the scan lines; and a plurality of display units, each comprising at least;

a first sub-pixel, controlled by one of the scan lines and used for receiving a first positive data voltage or a first negative data voltage from one of the data lines to generate luminance corresponding to a first grey value or a second grey value; and a second sub-pixel, controlled by one of the scan lines, wherein the first sub-pixel and the second sub-pixel are not the same in area or shape, the second sub-pixel is used for receiving a second positive data voltage or a second negative data voltage from one of the data lines to generate luminance corresponding to a third grey value or a fourth grey value;

wherein when the first to the fourth grey values are substantially equal, if the first positive data voltage is equal to the second positive data voltage, the first negative data voltage is not equal to the second negative data voltage.

4. The LCD according to claim 3, wherein each of the first sub-pixels further receives a third positive data voltage or a third negative data voltage from one of the data lines to generate luminance corresponding to a fifth grey value or a sixth grey value;

wherein when the third grey value is equal to the fourth grey value, the fifth grey value is equal to the sixth grey value and the third grey value is not equal to the fifth grey value; if the second positive data voltage is equal to the third positive data voltage, the second negative data voltage is not equal to the third negative data voltage.

5. A driving method, applied in a LCD having a plurality of display units and data lines, each display unit comprising at least a first sub-pixel and a second sub-pixel, the first sub-pixel and the second sub-pixel being not the same in area, the first sub-pixel used for receiving a first positive data voltage or a first negative data voltage from one of the data lines to generate luminance corresponding to a first grey value or a second grey value; the second sub-pixel used for receiving a second positive data voltage or a second negative data voltage from one of the data lines to generate luminance corresponding to a third grey value or a fourth grey value, the driving method comprising:

generating the first positive data voltage according to a first feed-through voltage of the first sub-pixel corresponding to the first grey value and inputting the first positive data voltage to the first sub-pixel;

generating the first negative data voltage according to a second feed-through voltage of the first sub-pixel corresponding to the second grey value and inputting the first negative data voltage to the first sub-pixel;

generating the second positive data voltage according to a third feed-through voltage of the second sub-pixel corresponding to the third grey value and inputting the second positive data voltage to the second sub-pixel; and generating the second negative data voltage according to a fourth feed-through voltage of the second sub-pixel corresponding to the fourth grey value and inputting the second negative data voltage to the second sub-pixel;

wherein when the first to the fourth grey values are substantially equal, an average value of the first positive data voltage and the first negative data voltage is not equal to an average value of the second positive data voltage and the second negative data voltage.

6. The driving method according to claim 5, wherein each of the first sub-pixels further receives a third positive data voltage or a third negative data voltage from one of the data lines to generate luminance corresponding to a fifth grey value or a sixth grey value, and the driving method further comprises:

setting the third positive data voltage according to a fifth feed-through voltage of the first sub-pixel corresponding to the fifth grey value;

setting the third negative data voltage according to a sixth feed-through voltage of the first sub-pixel corresponding to the sixth grey value;

wherein when the first grey value is equal to the second grey value, the fifth grey value is equal to the sixth grey value, and when the first grey value is not equal to the fifth grey value, the average value of the first positive data voltage and the first negative data voltage is not equal to an average value of the third positive data voltage and the third negative data voltage.

7. The driving method according to claim 6, wherein when the third grey value is equal to the fourth grey value, the fifth grey value is equal to the sixth grey value, and when the third grey value is not equal to the fifth grey value, if the second positive data voltage is equal to the third positive data voltage, the second negative data voltage is not equal to the third negative data voltage.

8. The driving method according to claim 5, wherein when the first to the fourth grey values are equal, if the first positive data voltage is equal to the second positive data voltage, the first negative data voltage is not equal to the second negative voltage.

* * * * *